United States Patent [19]

Tudisco

[11] 4,266,588

[45] May 12, 1981

[54] FLEXIBLE HANDLE FOR PERCUSSIVE TOOL WITH IMPROVED VERTEBRA MEMBER

[75] Inventor: Vincent J. Tudisco, Westwood, N.J.

[73] Assignee: White Development Corporation, Bennington, Vt.

[21] Appl. No.: 157,540

[22] Filed: Jun. 9, 1980

[51] Int. Cl.[3] ..... B25G 1/00

[52] U.S. Cl. ..... 145/61 D; 145/29 B; 145/29 R; 145/36; 145/61 M

[58] Field of Search ..... 145/61 D, 61 F, 61 H, 145/61 K, 61 M, 29 B, 29 R, 36

[56] References Cited

U.S. PATENT DOCUMENTS

| | | | |
|---|---|---|---|
| 31,997 | 4/1861 | Phillips | 145/61 M |
| 281,217 | 7/1883 | Wiedman | 145/61 D |
| 861,659 | 7/1907 | Johnston | 145/61 D |
| 1,033,171 | 7/1912 | Higgs | 145/29 R |
| 1,075,108 | 10/1913 | Keller | 145/29 R |
| 1,515,708 | 11/1924 | Stolle | 145/29 R |
| 1,601,520 | 9/1926 | Forbes | 145/61 K |
| 1,794,008 | 2/1931 | Forbes | 145/29 R |
| 2,337,440 | 12/1943 | Arrowood | 145/29 R |
| 2,603,260 | 7/1952 | Floren | 145/29 R |
| 2,741,456 | 4/1956 | Williams | 145/29 R |
| 2,757,694 | 8/1956 | Curtis | 145/29 R |
| 2,781,805 | 2/1957 | Freeman | 145/29 R |
| 2,809,684 | 10/1957 | Lyon | 145/61 D |
| 2,837,381 | 6/1958 | Sarlandt | 145/29 R |
| 2,940,492 | 6/1960 | Curry | 145/29 R |
| 3,208,724 | 9/1965 | Vaughan | 145/29 R |
| 3,341,261 | 9/1967 | Fenlin | 145/29 R |
| 3,385,334 | 5/1968 | Clay | 145/36 |
| 3,613,753 | 10/1971 | Wolf | 145/29 R |
| 4,039,012 | 8/1977 | Cook | 145/29 B |
| 4,089,356 | 5/1978 | O'Connor | 145/29 R |
| 4,096,895 | 6/1978 | Fernitz | 145/29 R |

FOREIGN PATENT DOCUMENTS

| | | | |
|---|---|---|---|
| 586106 | 12/1924 | France | 145/61 M |
| 585085 | 11/1958 | Italy | 145/36 |
| 2215 | 1/1890 | Sweden | 145/29 R |
| 98736 | 4/1940 | Sweden | 145/61 M |
| 131311 | 4/1951 | Sweden | 145/29 R |
| 163718 | 6/1922 | United Kingdom | 145/61 H |

*Primary Examiner*—Othell M. Simpson
*Assistant Examiner*—J. T. Zatarga

[57] ABSTRACT

A hammer of the type that includes a column of vertebra members is made of vertebra members having mating upper and lower abutment surfaces. Parts of adjacent abutment surfaces are mating concave and convex surfaces that slide across each other during pivoting in one direction so that the length of the shaft passage through the vertebra members is not increased during flexing of the hammer. Another portion of each abutment surface requires lengthening of the shaft passage if the vertebrae are to pivot in the other direction. Consequently, a shaft extending through the shaft passage and fixed at its upper and lower ends to the head and handle, respectively, prevents flexing in one direction but not in the other. Furthermore, the overwhelming majority of the resistance to flexing is provided by the shaft, not by interference between vertebra members, so the shaft size for a given resistance to flexing can be relatively large.

6 Claims, 4 Drawing Figures

FLEXIBLE HANDLE FOR PERCUSSIVE TOOL WITH IMPROVED VERTEBRA MEMBER

BACKGROUND OF THE INVENTION

The present invention relates to hand impact tools. It is particularly applicable to tools that are to be flexible in one direction but rigid in the other.

A significant advance in the field of hand impact tools was provided by the invention described in U.S. Patent Application Ser. No. 056,721 of Whiteford. The hammer described in that application includes a column of vertebra members extending from the handle to the head. Two shafts extend through the column from the handle to the head, one of which is free at least at one end and permitted to move with respect to the vertebra members in the column. The other column is fixedly attached at both ends. The resultant structure flexes in one direction when the head hits a workpiece, but it remains rigid when the claw side of the hammer is used. It is also believed that the use of a multiplicity of vertebra members enhances the shock absorption afforded by the flexible handle.

It is necessary in order to prevent flexing during use of the claw that the vertebra members be substantially incompressible, but flexing of the Whiteford hammer typically results in compressive force on the vertebrae in the region of the fixed shaft, and the opposing force from the vertebrae tends to oppose the desired flexing when a workpiece is struck. Some opposition to flexing is desirable, of course, so the shaft size would ordinarily be designed so that the sum of the resistances offered by the shaft and by the vertebra members would equal whatever level of resistance is desired. However, the resistance offered by the vertebra members limits the size of the shaft that can be used, and strength considerations sometimes make an increase in shaft size desirable.

It is accordingly an object of the present invention to maintain the advantages of the vertebra members while reducing the opposition to flexing incurred by their use. It is a related object to permit the use of larger-sized shafts in tools of this type.

SUMMARY OF THE INVENTION

The foregoing and related objects are achieved in a hand impact tool that includes an impact-tool head portion having first and second ends, a handle, an elongated shaft, and a multiplicity of vertebra members. The elongated shaft has one end fixedly connected to the handle and its other end fixedly connected to the impact-tool head portion intermediate its ends. The shaft is resiliently deflectable from the rectilinear axis of its at-rest position. The vertebra members are substantially incompressible and assembled into a column. Each vertebra member has a passage extending through it and the several passages form an elongated passage through the column. The shaft extends through the elongated passage, and deflection of the shaft requires relative pivoting of the vertebra members. A multiplicity of consecutive vertebra members of the column are substantially identically configured with abutment surfaces at their top and bottom margins extending generally transversely of the rectilinear axis of the shaft. One abutment surface of each vertebra member of the multiplicity of substantially identically configured consecutive vertebra members provides a concave recess, and the other abutment surface provides a convex boss complementarily configured to slidably seat in the concave recess. The recess and boss cooperate for limited pivoting of the convex boss relative to the recess in one direction from the rest position of the shaft about a pivotal axis extending perpendicularly to the axis of the elongated passage, and the abutment surfaces have cooperating portions substantially preventing pivoting from the rest position in the other direction. The passage is of greater transverse dimension than the shaft along at least a portion of its axial length so as to permit the limited pivoting of the vertebra member about the pivotal axis in the one direction concurrently with deflection of the shaft. Deflection of the shaft when one end of the head portion strikes a workpiece is thereby permitted, but deflection of the shaft in the other direction past the rest position is substantially prevented.

In the preferred embodiment, the head provides an abutment surface on its lower margin, and the vertebra member adjacent the head portion provides an abutment surface on its top margin. Either the abutment surface on the head or the abutment surface on the adjacent vertebra member provides a concave recess while the other provides a convex boss complementarily configured to slidably seat in the concave recess and cooperating with it for limited pivoting of the convex boss relative to the recess in one direction about a pivotal axis extending perpendicularly to the axis of the elongated passage. The abutment surface on the head portion and the abutment surface on the adjacent vertebra member have cooperating portions substantially preventing pivoting from the rest position in the other direction. Similarly, the handle provides an abutment surface on its top margin and the vertebra member adjacent the head portion provides an abutment surface on its lower margin. Either the abutment surface on the handle or the abutment surface on the adjacent vertebra member provides a concave recess, while the other provides a convex boss complementarily configured to slidably seat in the concave recess and cooperating with it for limited pivoting of the convex boss relative to the recess in one direction about a pivotal axis extending perpendicularly to the axis of the elongated passage. The abutment surface on the handle and the abutment surface on the adjacent vertebra member have cooperating portions substantially preventing pivoting from the rest position in the other direction.

The objects of the invention are also achieved in a hand impact tool that includes an impact-tool head portion having first and second ends, a handle, an elongated shaft, and a multiplicity of vertebra members. The shaft has one end fixedly connected to the handle and its other end fixedly connected to the impact-tool head portion intermediate its ends. The shaft is deflectable from the rectilinear axis of its rest position. The vertebra members are substantially incompressible and assembled into a column. Each has a passage extending through it, and the passages together form an elongated passage through the column. The shaft extends through the elongated passage, and deflection of the shaft requires relative pivoting of the vertebra members. Some of the abutment surfaces provide concave recesses, and abutment surfaces adjacent those with the concave recesses provide convex bosses slidably seated in the concave recesses and cooperating with them for limited pivoting of the convex bosses in one direction from the rest position of the shaft about a pivotal axis extending perpendicularly to the axis of the elongated passage.

The abutment surfaces have cooperating portions that substantially prevent pivoting from the rest position in the other direction. Deflection of the shaft when one end of the head portion strikes a workpiece is thereby permitted, but deflection of the shaft in the other direction past the rest position is substantially prevented. The recesses and bosses preferably are substantially in the form of surfaces of rotation about their respective pivotal axes to permit pivoting about the pivotal axes but substantially prevent relative rotation about the axis of the shaft. Such recesses and bosses may conveniently be substantially in the forms of cylinder segments.

BRIEF DESCRIPTION OF THE DRAWINGS

These and further features and advantages of the present invention are described in connection with the attached drawings, in which.

DETAILED DESCRIPTION OF THE PREFERRED EMBODIMENT

Figure 1:
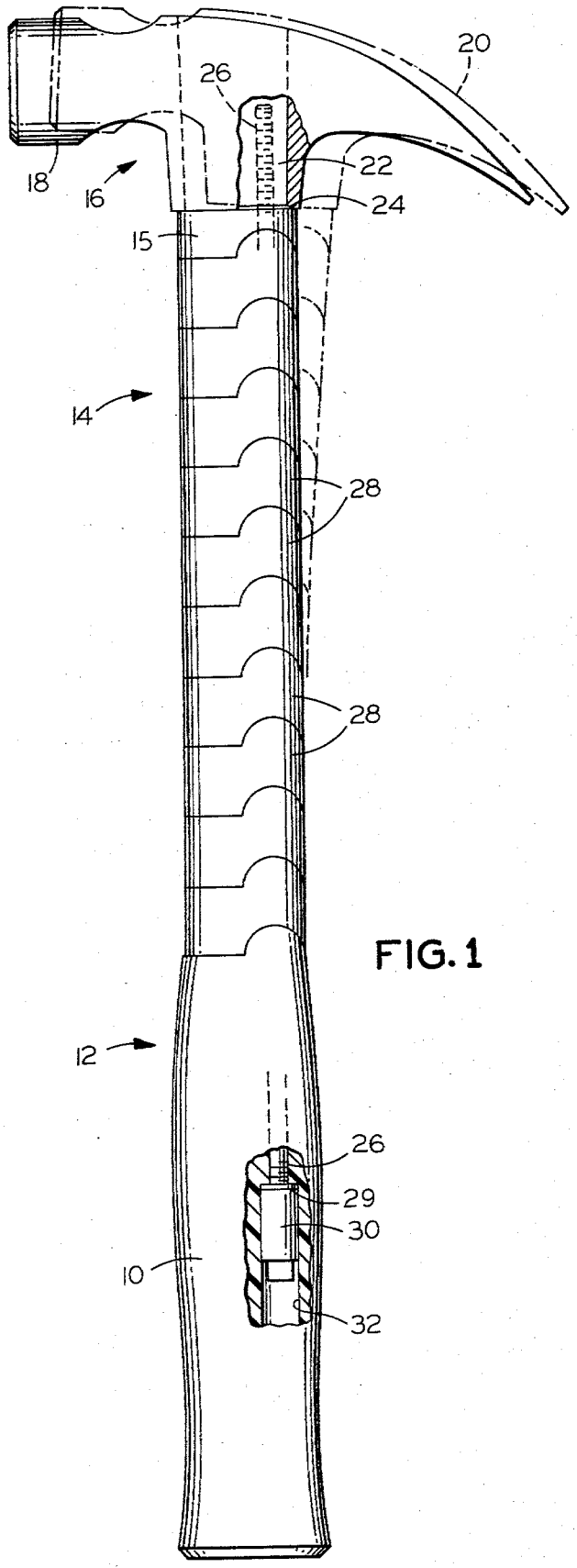
FIG. 1 is a side elevation, partly broken away, of a claw hammer that illustrates the teachings of the present invention.
Figure 2:
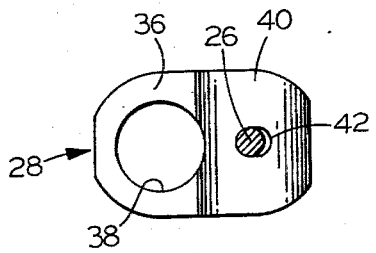
FIG. 2 is a plan view of a vertebra member from the hammer of FIG. 1.
Figure 3:
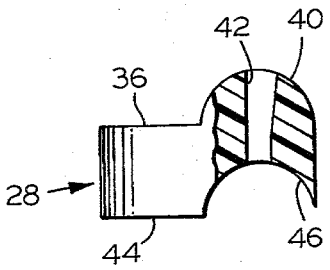
FIG. 3 is a side elevation, partly broken away, of the vertebra member of FIG. 2.

The drawings illustrate a hammer that includes a column 14 of vertebra members 28 of the type shown in FIGS. 2 and 3. These vertebra members have cooperating convex and concave surfaces 40 and 46 that permit the vertebra members to pivot by the sliding of cooperating surfaces along each other during flexing of the handle. Because of this sliding cooperation, flexing of the hammer to the right in FIG. 1 is possible without requiring the vertebra members to part near the passage 42 (FIG. 3) that contains the shaft 26. However, flexing to the left in FIG. 1 would require such parting, and it is accordingly prohibited by shaft 26 and cooperating flat surfaces 36 and 44.

The hammer of FIG. 1 includes a handle 12 having a molded grip 10 and a recess 32 extending longitudinally into it. A column 14 extends from handle 12 to a head portion 16 that includes the head proper 18 and a head insert 22 onto which head 18 is secured. The assembly is held together by a shaft 26 that is received in the recess 32 in the handle and is suitably secured in the insert 22 of head portion 16. In the preferred embodiment, the shaft is shown threaded at both ends; the threads on the upper end engage complementary threads in insert 22, and the threads on the lower end of shaft 26 are engaged by an appropriate nut 30 received in recess 32. Nut 30 bears against a suitable washer 29 and is employed to increase or decrease the tension on shaft 26.

As FIGS. 2 and 3 show, the vertebra members 28 that make up the column 14 all have passages 42 extending through them. These passages 42 are aligned to provide an elongated passage through which shaft 26 extends. As FIG. 2 shows in an exaggerated fashion, passage 26 is somewhat oblong in cross section at its upper end so as to allow for some movement of shaft 26 to the rear in the plane in which shaft 26 is to flex. FIG. 3 shows, also in an exaggerated fashion, that passage 42 diverges from a portion of circular cross section at the bottom of passage 42 to the more oblong cross section evident in FIG. 2. As a result, shaft 26 was a fairly snug fit in the lower portion of passage 42 but can move rearwards with respect to the upper portion of passage 42.

An opening 38 is also provided in each of the vertebra members. Its purpose is to facilitate the molding process; it is not critical to the functioning of the hammer. However, it is contemplated that some design could employ such a cavity as a container for a lubricating wick.

Each vertebra member 28 includes upper and lower abutment surfaces that abut similar surfaces on adjacent vertebra members. As FIG. 3 shows, the upper abutment surface includes a flat portion 36 and a convex boss 40. The lower abutment surface, which, like the upper abutment surface, extends generally transversely of the axis of shaft 26, also includes both a flat portion 44 and a curved portion 46. In the case of the lower abutment surface, however, the curved portion 46 is a concave recess whose shape is complementary to that of boss 40. Handle 12 also includes an abutment surface. Its abutment surface is complementary to the lower surface of the lowermost vertebra member. Head insert 22 widens at a shoulder 24 to provide a lower portion 15 that also has an abutment surface, this one cooperating with the upper abutment surface of the uppermost vertebra member.

Vertebra members 28 are substantially incompressible and can conveniently be molded from any of a number of tough plastics such as polyamides, polycarbonates, polyacetals, polypropylene, or acrylonitrile/-butadiene/styrene terpolymers. Specifically, samples have been made with glass-filled polyamide resin. In addition to such plastics, appropriate metals could make up the vertebrae.

Although it is apparent that other materials could be substituted, the material preferred for use in shaft 26 is spring-tempered steel. It has been found in particular that an SAE 8650 steel rod provides the desired flexibility. It is also expected that flat strip steel could be used in place of the rod.

Figure 4:
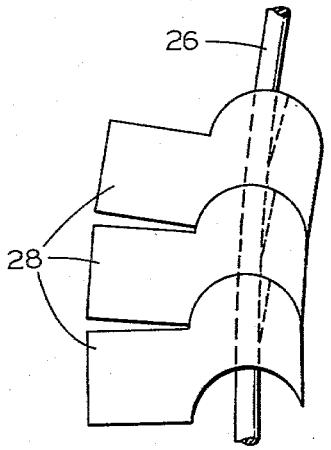
FIG. 4 is a side elevation with some vertebrae removed of part of the vertebra column of the hammer of FIG. 1 shown in a flexed position.

It is preferable for the complementary recesses and bosses to be in the form of surfaces of rotation about the pivotal axes. Specifically, the complementary surfaces 40 and 46 in the preferred embodiment are generally in the shape of cylinder segments. With such a shape, it is apparent that pivoting in the direction shown in FIGS. 1 and 4 is possible without any parting of the vertebra members in the neighborhood of the shaft; in other words, the length of the passage through the column remains essentially constant although the passage bends with the shaft. Consequently, the only resistance to bending provided by the vertebra members is the friction between the curved surfaces, not the force of vertebra members resisting compression.

In operation the hammer will flex when it strikes a workpiece because of the flexibility of shaft 26. This is suggested by phanthom 20 of FIG. 1. With the accompanying bending of shaft 26, relative pivoting of adjacent vertebrae results, as FIG. 4 illustrates. At the interface between the upper portion of one passage 42 and the adjacent lower portion of the passage through the vertebra above it, relative motion is permitted between the shaft and the upper portion of the one passage but not between the shaft and the lower portion of the adjacent passage. Relative motion between adjacent vertebrae therefore results at the interfaces.

A different situation obtains when the claw side of the hammer is to be used. The tendency when the claw is in use would be for the hammer to bend in the direction opposite that shown in FIGS. 1 and 4. However, when force is applied to the hammer in this direction, shaft 26 and the several flat portions 36 and 44 on vertebra members 28 cooperate to prevent flexing. Specifically, surfaces 36 and 44 on the vertebra members abut in the rest position shown in FIG. 1 to make it necessary for the vertebrae to part in the region around the passage through the column. This would effectively lengthen the passage through the column, but such lengthening is prevented because shaft 26 is fixedly connected both at the handle and at the head to limit the length of the column at the position of the passage. Consequently, flexing in the direction opposite to that shown in FIG. 4 is not permitted.

It is apparent that the invention described in connection with the embodiment shown in the drawings provides a significant improvement in the type of hammer that employs a column of vertebrae. By employing the sliding and pivoting abutment surfaces of the present invention, flexure of the column in the desired direction is possible without any significant resistance due to compressive force on the vertebrae. As a result, the present invention permits a larger-diameter shaft to be used for a given amount of resistance to flexing than prior art arrangements do, and the strength of the tool is thus increased.

Having thus described the invention, I claim:

1. A hand impact tool comprising:

a. an impact-tool head portion having first and second ends;

b. a handle;

c. an elongated shaft having one end fixedly connected to said handle and its other end fixedly connected to said impact-tool head portion intermediate the ends thereof, said shaft being resiliently deflectable from the rectilinear axis of its rest position; and d. a multiplicity of substantially incompressible vertebra members assembled into a column, said vertebra members each having a passage extending therethrough forming an elongated passage through said column, said shaft extending through said elongated passage, deflection of said shaft requiring relative pivoting of said vertebra members, a multiplicity of consecutive vertebra members of said column being substantially identically configured with abutment surfaces at the top and bottom margins thereof extending generally transversely of said rectilinear axis of said shaft, one abutment surface of each vertebra member of said multiplicity of substantially identically configured consecutive vertebra members providing a concave recess, and the other abutment surface providing a convex boss complementarily configured to slidably seat in said concave recess, said recess and boss cooperating for limited pivoting of said convex boss relative to said recess in one direction from said rest position of said shaft about a pivotal axis extending perpendicularly to said axis of said elongated passage, said abutment surfaces having cooperating portions substantially preventing pivoting from said rest position in the other direction, said passage being of greater transverse dimension than said shaft along at least a portion of its axial length so as to permit said limited pivoting of said vertebra member about said pivotal axis in said one direction concurrently with deflection of said shaft, whereby deflection of said shaft when one end of said head portion strikes a workpiece is permitted but deflection of said shaft in the other direction past said rest position is substantially prevented.

2. The hand impact tool of claim 1 wherein said head provides an abutment surface on the lower margin thereof, the vertebra member adjacent said head portion providing an abutment surface on the top margin thereof, one of said abutment surface on said head and said abutment surface on said adjacent vertebra member providing a concave recess and the other providing a convex boss complementarily configured to slidably seat in said concave recess and cooperating therewith for limited pivoting of said convex boss relative to said recess in one direction about a pivotal axis extending perpendicularly to said axis of said elongated passage, said abutment surface on said head portion and said abutment surface on said adjacent vertebra member having cooperating portions substantially preventing pivoting from said rest position in the other direction.

3. The hand impact tool of claim 1 or 2 wherein said handle provides an abutment surface on the top margin thereof, the vertebra member adjacent said head portion providing an abutment surface on the lower margin thereof, one of said abutment surface on said handle and said abutment surface on said adjacent vertebra member providing a concave recess and the other providing a convex boss complementarily configured to slidably seat in said concave recess and cooperating therewith for limited pivoting of said convex boss relative to said recess in one direction about a pivotal axis extending perpendicularly to said axis of said elongated passage, said abutment surface on said handle and said abutment surface on said adjacent vertebra member having cooperating portions substantially preventing pivoting from said rest position in the other direction.

4. A hand impact tool comprising:

a. an impact-tool head portion having first and second ends;

b. a handle;

c. an elongated shaft having one end fixedly connected to said handle and its other end fixedly connected to said impact-tool head portion intermediate the ends thereof, said shaft being deflectable from the rectilinear axis of its rest position; and d. a multiplicity of substantially incompressible vertebra members assembled into a column, said vertebra members each having a passage extending therethrough forming an elongated passage through said column, said shaft extending through said elongated passage, deflection of said shaft requiring relative pivoting of said vertebra members, some of said abutment surfaces providing concave recesses, abutment surfaces adjacent those with said concave recesses providing convex bosses slidably seated in said concave recesses and cooperating therewith for limited pivoting of said convex bosses in one direction from said rest position of said shaft about a pivotal axis extending perpendicularly to said axis of said elongated passage, said abutment surfaces having cooperating portions substantially preventing pivoting from said rest position in the other direction, whereby deflection of said shaft when one end of said head portion strikes a workpiece is permitted but deflection of said shaft in the other direction past said rest position is substantially prevented.

5. The hand impact tool of claim 1 or 4 wherein said recesses and bosses are substantially in the form of surfaces of rotation about their respective pivotal axes to permit pivoting about said pivotal axes but substantially prevent relative rotation about the axis of said shaft.

6. The hand impact tool of claim 5 wherein said recesses and bosses are substantially in the forms of cylinder segments.

* * * * *